United States Patent [19]

Holtrop et al.

[11] 4,452,123

[45] Jun. 5, 1984

[54] COMPOSITE ROUND/RAPID FIRE GUN

[75] Inventors: John W. Holtrop; Bruce C. Bartels, both of Ridgecrest, Calif.

[73] Assignee: The United States of America as represented by the Secretary of the Navy, Washington, D.C.

[21] Appl. No.: 353,787

[22] Filed: Mar. 1, 1982

[51] Int. Cl.[3] ..... F41F 3/02

[52] U.S. Cl. ..... 89/1.706; 89/16; 89/33.03

[58] Field of Search ..... 89/33 MC, 155, 1.7, 89/1.703, 16, 13 R, 1.805; 102/703; 42/15, 39.5

[56] References Cited

U.S. PATENT DOCUMENTS

| | | | |
|---|---|---|---|
| 672,300 | 4/1901 | Turnbull | 89/33 MC |
| 2,851,927 | 9/1958 | Smith | 89/33 MC |
| 2,979,991 | 4/1961 | Buschers et al. | 89/1.7 |
| 2,998,758 | 9/1961 | Ouellette | 89/155 |
| 3,046,842 | 7/1962 | Sergay | 89/155 X |
| 3,429,220 | 2/1969 | Goode | 89/33 MC |
| 3,446,111 | 5/1969 | Dardick | 89/1.7 |
| 3,476,048 | 11/1969 | Barr | 102/703 X |
| 3,547,001 | 12/1970 | Stoner | 89/33 MC X |
| 3,817,148 | 6/1974 | Schirneker | 89/155 |
| 3,827,332 | 8/1974 | Lindsay | 89/1.7 |
| 4,015,527 | 4/1977 | Evans | 102/703 X |

FOREIGN PATENT DOCUMENTS

| | | | |
|---|---|---|---|
| 2258166 | 7/1973 | Fed. Rep. of Germany | 89/155 |

*Primary Examiner*—Donald G. Kelly

*Attorney, Agent, or Firm*—Robert F. Beers; W. Thom Skeer; Kenneth G. Pritchard

[57] ABSTRACT

A rapid fire gun round is made with a composite chamber. The chamber is loaded by rotational motion rather than by reciprocating motion. The round will work in a recoilless gun configuration. An alternate arrangement permits multiple barrels to be arranged with an ammunition chain to form a Gatling gun configuration. A liner can be inserted in the gun barrel to be replaced with wear as appropriate.

5 Claims, 5 Drawing Figures

COMPOSITE ROUND/RAPID FIRE GUN

BACKGROUND OF THE INVENTION

1. Field of the Invention

The present invention is for rapid fire gun systems. In particular, the present invention is for rapid fire gun systems that are adaptable to aircraft. In particular, the present invention permits rapid fire gun rates with relatively few moving parts and higher expected system lifetimes.

2. Description of the Prior Art

All current rapid fire weapons use a case round. The case, typically metallic, contains the gunpowder, igniter, and projectile. The case usually provides a gas seal to form a snug fit within the barrel of the weapon. In operation, the round is mechanically rammed into the chamber, locked in place, and fired. The movement of the round usually requires a distance of about 10 calibers. After the internal pressure subsides, the mechanism is unlocked and the spent case retracted for the same distance. A fresh round is then brought into position and the cycle repeated. This mechanism is extremely complex and requires the exact synchronization of feed, ram, and lock systems. The long reciprocating motions require large forces with heavy components. This results in a slow cycle rate. The heat build-up in the chamber area is rapid and often limits gun operation.

The reciprocating motion can be simplified by using rotary motion. The common police revolver is an example of this type of simplification. The revolver, containing a conventional cased round, only has to index a distance of about two calibers between shots. While this mechanism is simple and the component dynamics are improved, the system becomes too bulky with more than the traditional six shots. The revolver concept has not been mated previously to the recoilless rifle technique.

SUMMARY OF THE INVENTION

A rapid fire gun using composite chambers as the loaded round is sequentially aligned with barrels similar to a revolver. The rounds contain the usual powder, igniter, projectile, and seal, but are designed to withstand firing pressure without using a conventional chamber. The powder and projectile are contained within a cylinder fabricated from a composite material. The composite material is built by winding a filament around a very thin aluminum tube. The chambers can either be fed sequentially into a single rifle barrel or they can be fed in a Gatling configuration with a plurality of barrels.

An object of the present invention is to provide a mechanism which uses the simplicity of a revolver system for large caliber guns. A further object of the present invention is to provide a rapid fire revolver gun system which is suitable for use on aircraft.

BRIEF DESCRIPTION OF THE DRAWINGS

FIG. 4 shows a side view of a recoilless rifle configuration mounted under an aircraft wing.

DESCRIPTION OF THE PREFERRED EMBODIMENT

Figure 1:
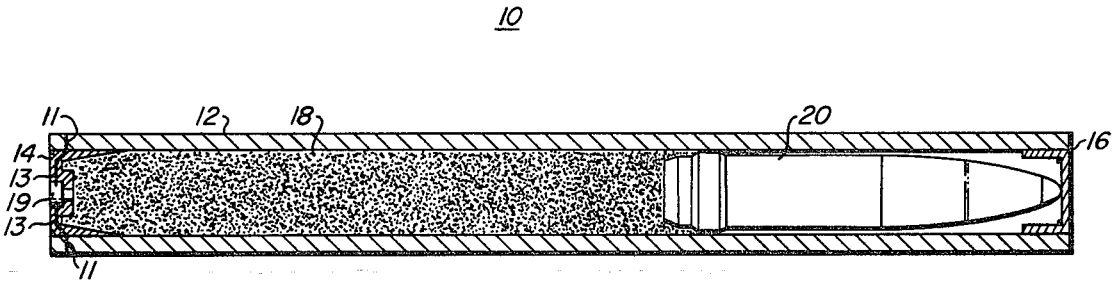
FIG. 1 is a cross-sectional view of a composite round used in the present invention.

FIG. 1 shows a loaded round 10. Composite wall 12 forms a right circular cylinder. Wall 12 can be built from composite material. Numerous materials are readily available under various commercial trademarks. An example of one such material suitable for the present invention is KEVLAR. The composite material is built by winding a filament around a very thin aluminum tube. The filament can be graphite, fiberglass, or steel wire as applied with or without a bonding resin. O-ring seals are placed at the rear 14 and at the front 16 of loaded round 10. Between the seals, powdered charge 18 is placed behind a projectile 20. Any standard ignition means 19 is used to ignite charge 18. Ignition means 19 may be detonated by concussion or electrical signal. Electrical signals would be received via leads 13 to an electrical conducting ring 11. Ring 11 is a well known technique for detonation of recoilless weapons. Ring 11 contacts a barrel contact section 11A when placed in the barrel of a recoilless gun. This regular shape of round 10 allows more efficient storage and handling compared to the conventional tapered, irregular cartridges.

Figure 2:
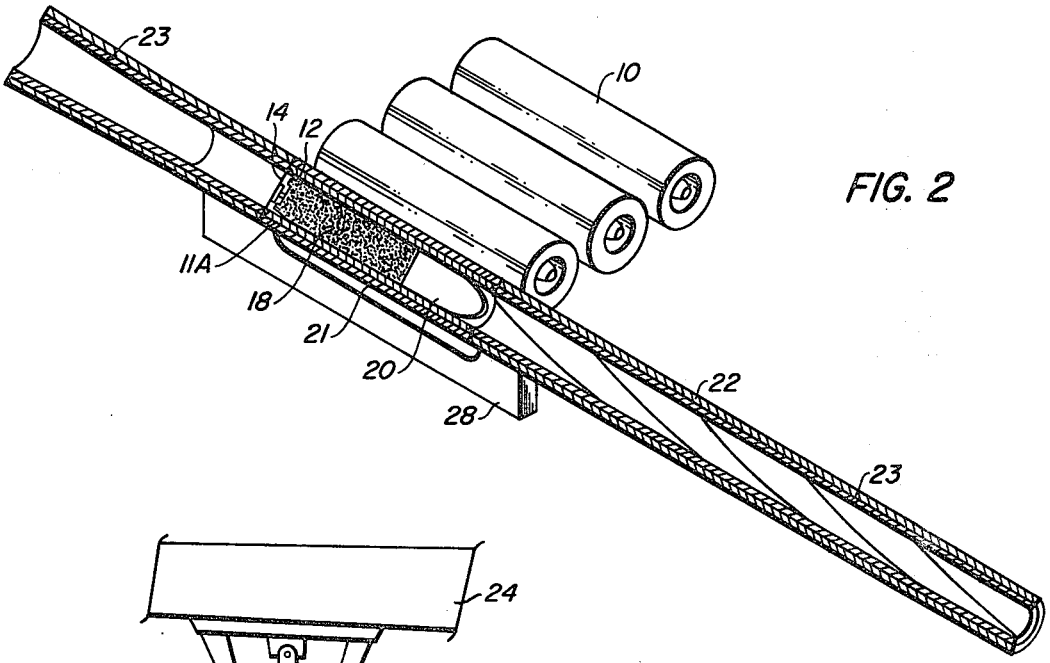
FIG. 2 shows a cross-sectional view of a recoilless rifle barrel configuration suitable for the present invention.

FIG. 2 shows loaded rounds 10 being sequentially aligned with a barrel 22, similar to a revolver. Barrel 22 is shown as a recoilless gun. Rounds 10 are equally suitable for use in non-recoilless barrels. Barrel 22 is shown with a steel liner 23. Steel liner 23 is a replaceable liner which increases barrel lifetime by permitting the normal barrel wear to be absorbed by liner 23. The recoilless configuration can be used in aircraft. Round 10 fits within a segment 21 of barrel 22. Segment 21 has an internal radius slightly greater than round 10's external radius. Wall 12 is blocked between fore and aft sections of liner 23 as shown. Round 10 is blocked in this manner even if liner 23 is not a replaceable liner. For a recoilless configuration, segment 21 has a contact section 11A which makes electrical contact with conducting ring 11 of round 10 as shown in FIG. 1. For a recoilless gun, the momentum carried by the exhaust gases through the aft end of the barrel equals the momentum of projectile 20 as it travels in the opposite direction. O-ring seal 14 is blown away shortly after ignition of charge 18. A pod 28 supports barrel 22.

Figure 3:
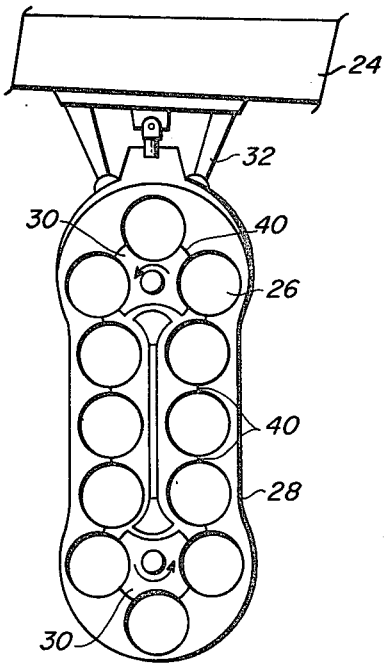
FIG. 3 shows a sectional diagram of an indexing pod suitable for the present invention.

FIG. 3 shows a dozen rounds arranged like links on a chain. They are shown mounted and braced beneath an aircraft wing 24 by structs 32. Twelve chambers 26 are shown within an indexing pod 28. Each chamber 26 contains a loaded round 10, as shown previously. Chambers 26 are indexed together by indexing means 30 to sequentially align with the common barrel. Indexing means 30 controls the firing rate. Chambers 26 are joined by links 40 which pull chambers 26 in series as indexing means 30 rotate with chambers 26 as shown by the arrows. FIG. 4 shows a profile view of pod 28 and barrel 22 under wing 24.

The recoilless configuration shown in FIG. 2 has many uses. For larger caliber systems, the chain of ammunition could contain a wide variety of rounds. With a simple computerized bookkeeping system, the operator could select his round, the chain would index appropriately, and the gun fire. Examples or types of rounds that can be fired include: (1) well known various warhead and fuze options; (2) guided projectiles, such as laser, infrared, and so forth; (3) submunitions; (4) rockets, guided or ballistic; and (5) electronic countermeasures, ECM, packages. The last three munitions can be expended backwards, through the nozzle of the recoilless rifle configuration. This will provide a new dimension for aircraft tactics. A pilot could attack using conventional projectiles, then scatter submunitions in an ECM package as he passes over the target, and finally, use rearfiring rockets or missiles to protect his retreat.

Figure 5:
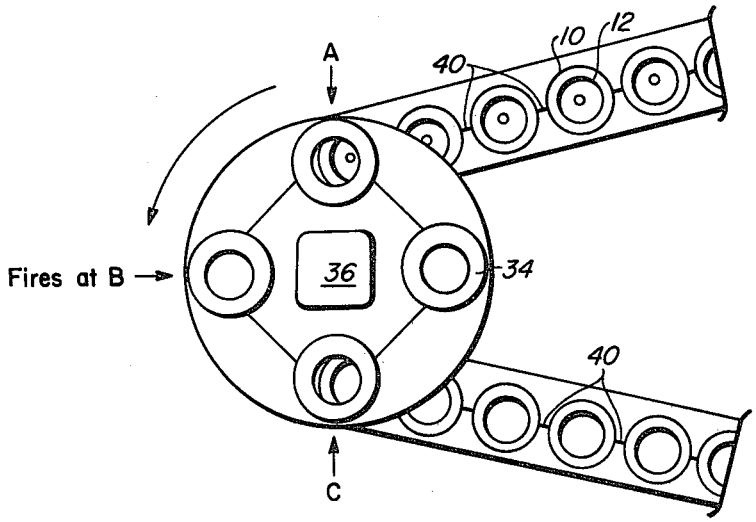
FIG. 5 shows a sectional view of a Gatling gun configuration for the present invention.

FIG. 5 shows a Gatling configuration which incorporates a cluster of four rotating barrels 34. Rotating barrels 34 pull the ammunition chain, shown as a series of rounds 10, through the gun. By matching barrels to chain pitch via a centering mechanism 36, a loaded round begins to line up with its barrel at point "A", fires at point "B", and the empty chamber is removed at point "C". For the recoil to be absorbed, the back of round 10 is against a solid support, not shown, which seals the back end of the gun barrel. This is well known state of the art and such a surface may have a hammer mechanism to fire the round similar to a revolver. The Gatling rounds may also be fired as shown in FIG. 2. However, as shown in FIG. 5, wall 12 of round 10 is blocked by gun barrel 34. A liner may not be sufficient to block round 10 as shown in FIG. 1. Liners may be used with additional state of the art blocking methods. The motion involved is pure rotation, omitting any indexing or reciprocating type motions. Conventional bolt lock and case extraction cycles are completely eliminated. Assuming normal action times and burn rates, a four barrel design can fire 8000 shots per minute, a factor of two improvement over existing gun rates. Only two pieces move, the chain of ammunition and the barrels.

Since a fresh chamber is used for every shot, the erosion damage, following misfires, leakage, and overheating problems are greatly reduced. Even a ruptured chamber is unlikely to stop the gun. In conventional guns, gas leakage occurs if the head of the cartridge fails, thereby stopping the gun. A similar seal failure is much less damaging in the composite chamber design since all damaged components are replaced with the next shot.

The development of high strength low weight composite material allows combining the conventional cartridge case and gun chamber without a weight penalty. This simplifies gun design while allowing higher firing rates and lower production costs. The illumination of reciprocating motion simplifies the firing cycle by reducing acceleration forces and increasing the firing rate. The conventional bolt lock and case extraction cycles are eliminated in both the FIG. 2 and FIG. 5 modes shown. The composite chamber is a right circular cylinder. This regular shape allows more efficient storage and handling compared to the regular tapered cartridges.

It is obvious to those skilled in the art that numerous modifications of the above methods may be made.

I claim:

1. A rapid fire gun suitable for use on aircraft comprising:

a barrel;

a barrel liner mounted within said barrel, said liner having fore and aft sections separated by a predetermined space within said barrel;

an indexing pod containing a plurality of chambers which are sequentially aligned with said barrel such that a chamber placed within the barrel is blocked in said predetermined space between said fore and aft liner sections by said fore and aft liner sections;

a plurality of enclosed gun rounds, one in each chamber of said indexing pod and where each of said enclosed rounds further comprises:

a composite walled container;

a projectile in one end of said container;

combustion means for propelling said projectile at the other end of said container; and sealing means at each end of said container holding said projectile and combustion means in said container until ignition of the combustion means; and igniting means between the barrel and the enclosed round for igniting said combustion means when said enclosed round is in the barrel.

2. A rapid fire gun as described in claim 1 where said barrel is a recoilless rifle barrel.

3. A rapid fire gun as described in either claim 1 or claim 2 where said barrel liner comprises a replaceable liner.

4. A rapid fire gun as described in either claim 1 or claim 2 where said container comprises a cylindrical shell made of composite material.

5. A rapid fire gun as described in claim 3 where said container comprises a cylindrical shell made of composite material.

* * * * *